United States Patent [19]

Courtney et al.

[11] Patent Number: 5,058,776

[45] Date of Patent: Oct. 22, 1991

[54] APPARATUS FOR DISPENSING PARTICULATE MATERIAL FOR FOUNDRY FURNACE RELINING

[75] Inventors: Michael L. Courtney, Welland; Joseph S. Hockey, Pelham; Ayton J. Grady, Niagara Falls, all of Canada

[73] Assignee: General Motors of Canada Limited, Oshawa, Canada

[21] Appl. No.: 491,479

[22] Filed: Mar. 9, 1990

[51] Int. Cl.[5] ..... B67D 5/64

[52] U.S. Cl. ..... 222/168; 222/169; 222/412; 414/401; 414/526; 141/231; 141/284; 141/363

[58] Field of Search ..... 222/160, 167–169, 222/171, 172, 608, 412, 413; 414/326, 401, 526, 188; 198/587, 861.6; 141/231, 284, 363

[56] References Cited

U.S. PATENT DOCUMENTS

| | | | |
|---|---|---|---|
| 565,068 | 8/1896 | Dornfeld | 414/287 |
| 1,137,979 | 5/1915 | Kailor | 198/674 |
| 1,165,760 | 12/1915 | Craine | 198/657 X |
| 1,184,942 | 5/1916 | Gardner | 198/861.61 |
| 3,145,855 | 8/1964 | Plugge et al. | 222/412 |
| 3,265,225 | 8/1966 | Louks | 414/302 |
| 3,669,076 | 6/1972 | Ellis | 222/169 X |
| 3,799,404 | 3/1974 | Taupin | 222/168 |
| 4,220,433 | 9/1980 | Feterl | 414/298 |

FOREIGN PATENT DOCUMENTS

| | | | |
|---|---|---|---|
| 145561 | 6/1954 | Sweden | 222/168 |

*Primary Examiner*—Kevin P. Shaver
*Attorney, Agent, or Firm*—Douglas D. Fekete

[57] ABSTRACT

An apparatus of this invention for dispensing particles into an annular pattern is preferably employed in relining a foundry furnace. The furnace relining operation comprises positioning an expendable steel form in the furnace spaced apart from an outer wall, filling the annular space with refractory particles, and sintering the particles into a continuous lining. The apparatus of this invention comprises a platform removably positioned atop the form and having a circular track. The apparatus further comprises a carriage rotatably mounted on the platform and riding on wheels that travel along the circular track. A supply of the refractory particles is loaded into a hopper carried by the carriage. A feeder conveys particles from the hopper for discharge into the space. During use, the carriage rotates while continuously dispensing particles to uniformly distribute the particles into the space. After filling, the apparatus is removed from the form, whereafter the refractory particles are sintered into a continuous lining.

4 Claims, 2 Drawing Sheets

APPARATUS FOR DISPENSING PARTICULATE MATERIAL FOR FOUNDRY FURNACE RELINING

TECHNICAL FIELD

This invention relates to an apparatus for use in producing a refractory lining within a foundry furnace and, more particularly, to an apparatus for dispensing particulate refractory material into an annular space within the furnace in preparation for sintering into a continuous lining.

BACKGROUND OF THE INVENTION

A common foundry induction furnace comprises a cylindrical outer wall, typically including an induction heating coil, and a continuous lining formed of sintered silica or other refractory material defining a chamber for containing molten metal, such as an iron melt. From time to time, the lining becomes eroded and requires replacement. Following removal of the worn lining, an expendable steel cylindrical form is concentrically installed within the furnace spaced apart from the outer wall so as to define an annular space. Refractory particles are supplied in bags and manually poured into the space. This refractory is sintered first by gas heaters fired into the furnace, and thereafter by an initial charge of molten iron melted within the furnace. The initial charge also melts the expendable form to reveal the sintered lining.

Manual dumping of the particles from bags into the space is a dirty, laborious and time-consuming job. Workers are required to wear bulky protective clothing and use respirators. Also, air tends to be entrapped in the particulate body to produce voids in the lining that physically weaken the lining or create pockets of overheated metal.

It is an object of this invention to provide an apparatus for conveniently and quickly dispensing particulate material into an annular space, such as, in a preferred embodiment, the space between a foundry furnace outer wall and an expendable steel form during operations to form a continuous, sintered refractory lining. The apparatus evenly and continuously distributes the particulate material in a helical pattern to progressively and uniformly fill the space.

SUMMARY OF THE INVENTION

In a preferred embodiment, the apparatus of this invention is employed to produce a sintered refractory lining within a foundry furnace and provides a continuous and regulated supply of refractory particles into an annular space between an expendable steel form and an outer wall. The apparatus sits on top of the form and rotates about a central axis while continuously and gradually feeding the refractory material directly into the space.

More particularly, the apparatus comprises a platform and a carriage rotatably mounted on the platform. The carriage and platform are unitized through a centralized pivot construction so that the apparatus may be lifted by a crane for placement onto and removal from the steel form. The platform fits on top of the steel form and includes a circular track inboard the space. The carriage rides on wheels that travel along the track as the carriage rotates. The carriage carries a hopper for containing a reservoir of particulate material and a screw feeder for conveying the material from the hopper and discharging the material into the space.

During furnace lining operations, the carriage rotates on the platform as the screw feeder concurrently disperses refractory material from the hopper into the space at a controlled rate to continuously and uniformly fill the space. Following removal of the apparatus from the form, the material is sintered in accordance with conventional practice to produce an integral lining having reduced porosity.

BRIEF DESCRIPTION OF THE DRAWINGS

These and other features, objects and advantages of this invention will become more apparent from the following detailed description and drawings in which.

DETAILED DESCRIPTION OF THE INVENTION

Figure 1:
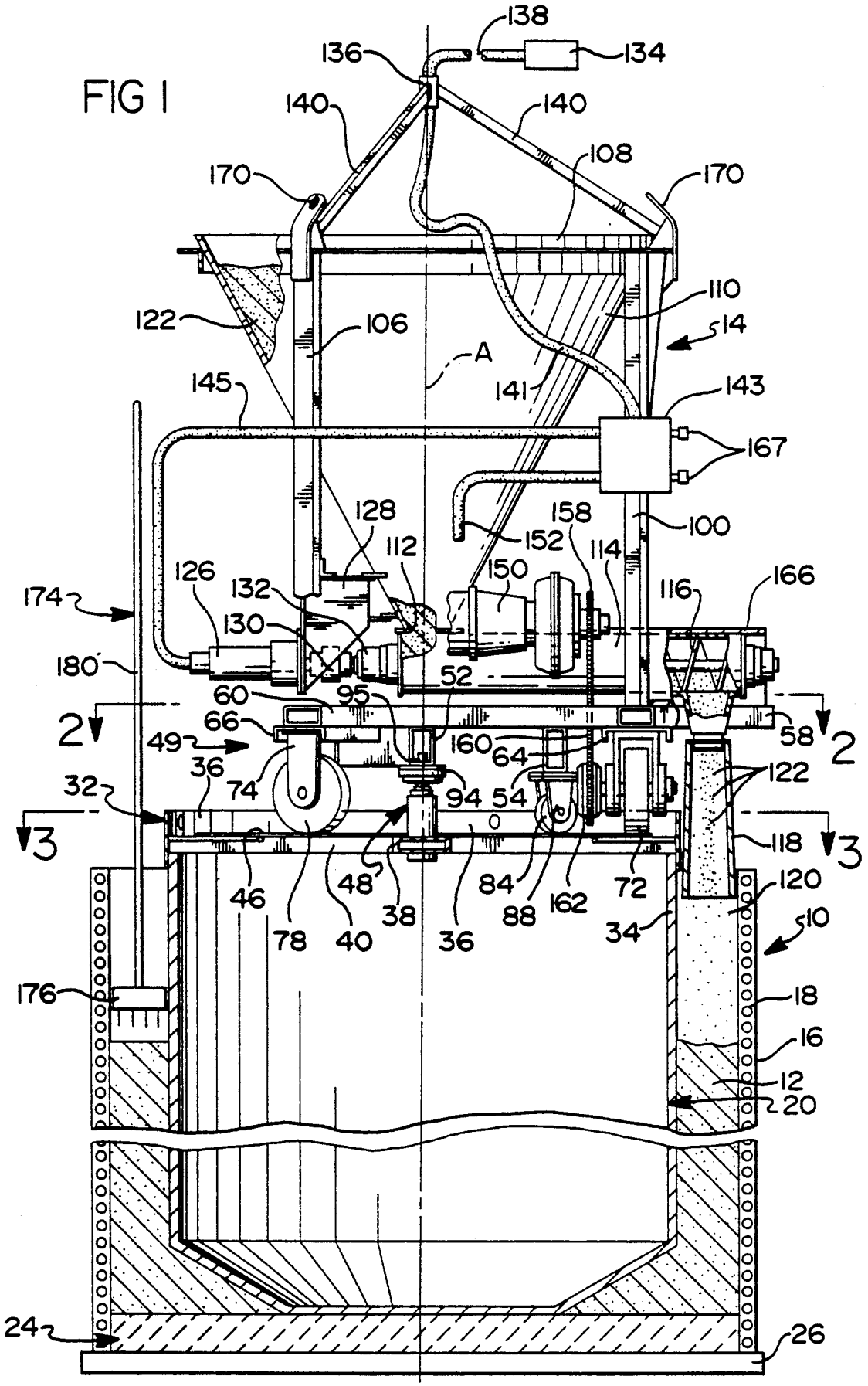
FIG. 1 is a diagrammatic side view of a preferred embodiment of this invention.
Figure 2:
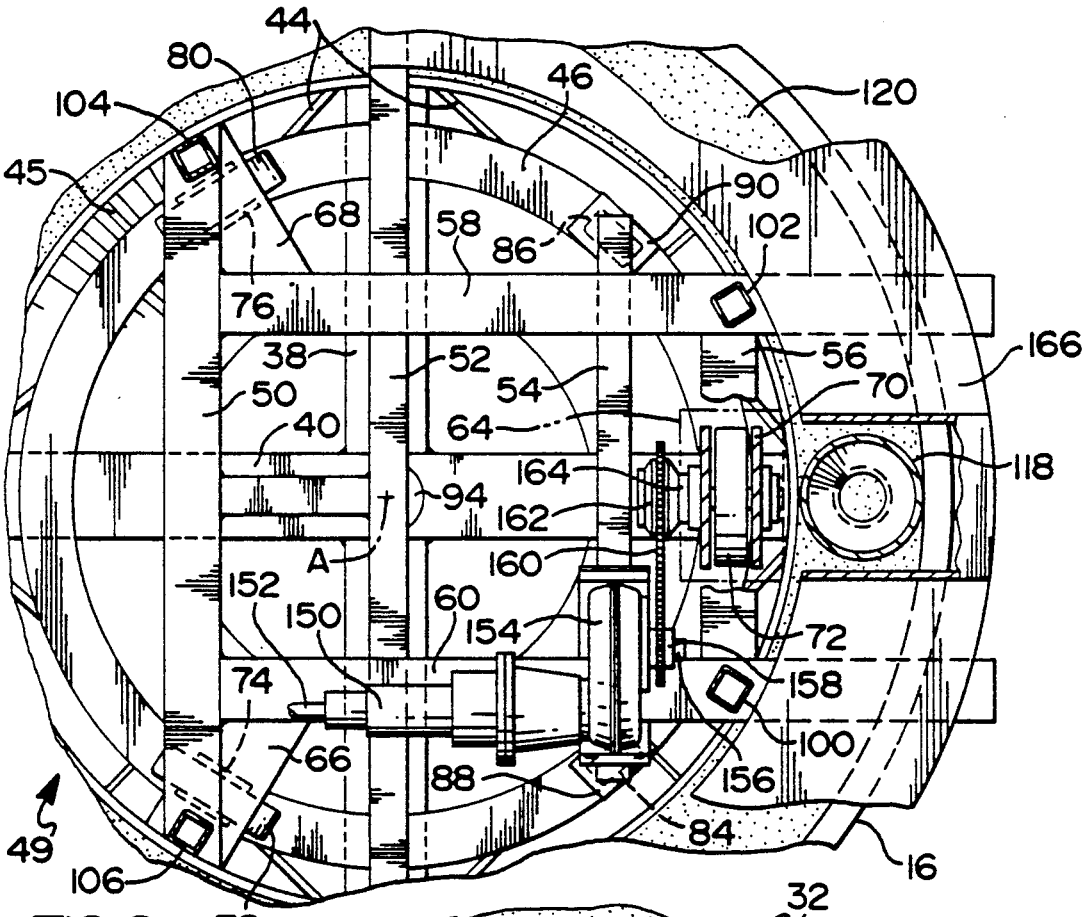
FIG. 2 is a view taken generally along lines 2—2 of FIG. 1 and with some parts broken away and some parts removed.
Figure 3:
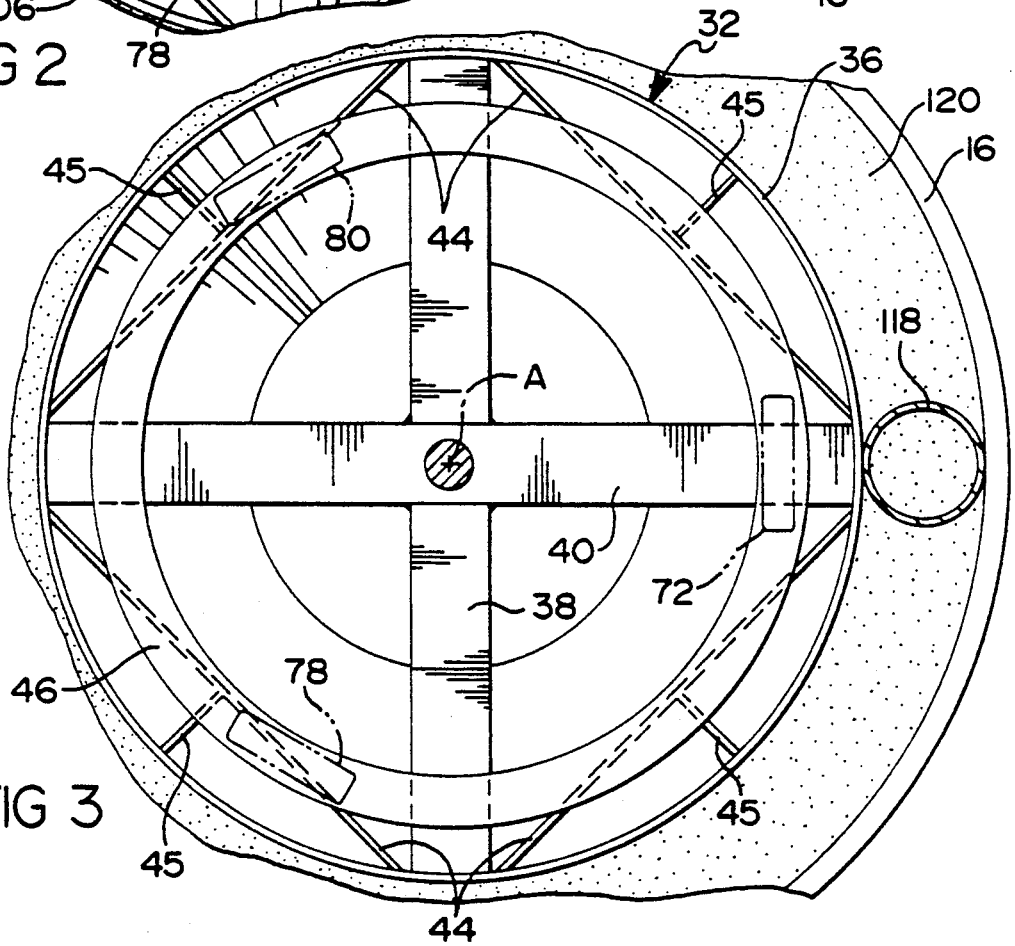
FIG. 3 is a sectional view generally taken along lines 3—3 of FIG. 1 with some parts broken away.

Referring to the drawings, in accordance with a preferred embodiment, a rotary feeder apparatus 14 of this invention is employed during relining of a foundry furnace 10 to lay down a body 12 of silica particles that is sinterable into a product lining.

More particularly, the furnace 10 has an outer grout wall 16 having an induction heater coil 18 embedded therein. Outer wall 16 is cylindrical about a central axis A and supported upon a foundation 26. For relining, an open-top, expendable steel liner 20 is placed within the furnace seated on a refractory base 24 and includes a cylindrical side wall 34 concentric with wall 16 about axis A, spaced apart by an annular space 120.

Apparatus 14 comprises a platform 32 set atop the form 20. The platform 32 includes a circular rim 36 that fits about the open top of liner 20 to position the apparatus. Platform 32 is reinforced by diametrical cross supports 38 and 40, cordal braces 44 welded to rim 36, and radial braces 45 interconnecting braces 44 and rim 36. Cross supports 38 and 40 and braces 44 and 45 carry an upper annular track 46 concentric with rim 36 and a central upstanding pivot connector assembly 48 having the pivot axis coinciding with axis A when the platform is positioned on the liner.

The refractory feeder apparatus 14 has a carriage 49 formed of interconnected tubular steel channels 50, 52, 54, 56, 58 and 60. Secured to the carriage are plates 64, 66 and 68 which respectively carry bracket 70 for drive wheel 72 and brackets 74 and 76 for support wheels 78 and 80 which roll on the annular track 46 during the rotary operation of the feeder. Caster wheel assemblies 84, 86 mounted by brackets 88 and 90 to the undercarriage also ride on the circular track 46 and provide additional support.

Pivot connector assembly 48 comprises a bearing assembly 94 affixed to channel 52 and rotatable about pivot pin 95 aligned coincidentally with pivot axis A. Bearing assembly 94 and pin 95 are secured axially to join platform 32 and carriage 49 together to allow feeder 14 to be lifted and transported as a single unit.

Carriage 49 further comprises a plurality of steel tubular uprights 100, 102, 104 and 106 that extend upwardly into attachment with an annular rim 108. Lugs 170 attached to the upper end of the hopper are provided for attachment to a crane so that the complete assembly can be lifted onto and off from liner 20.

The carriage supports a conical hopper 110 for containing a supply of refractory particles 122. The lower end of hopper 110 has a centrally located port 112 that communicates with a tubular conduit 114 which extends radially to a vertical drop discharge nozzle 118. As shown in the Figures, nozzle 118 registers with space 120 for directing particles 122 discharged from conduit 114 into the space. Particles 122 are fed along conduit 114 by a rotatable screw conveyer 116 driven by an air motor 126 mounted by bracket 128 to one upright 106. The air motor 126 is drivingly connected to conveyer 116 by flex-shaft coupling 130 and input shaft 132. Pressurized air for powering motor 126 is supplied from a remote source 134 through a stationary airline 138 and an airline 141 mounted on the carriage, interconnected by a rotatable air coupling 136 supported by braces 140 to permit rotation of the carriage without interruption of the pressurized air. The pressurized air is fed from lines 141 to pressure regulator 143 and then through line 145 to the motor 126.

A second air motor 150 also receives air pressure from supply 134 and lines 141 via pressure regulator 143 and airline 152. Motor 150 through a transmission 154 drives an output shaft 156 on which gear 158 is mounted. Extending around gear 158 is a drive chain 160 which drives a gear 162 that has an output shaft 164 that drives the drive wheel 70.

A semicircular platform 166 is supported on horizontal channels 52, 58 and 60 and has steps to bridge conduit 114. An operator standing on platform 166 manually adjusts regulator 167 to control the rotary speed of the refractory feeder and the rotation of screw conveyer 116 to control the rate of discharge of particles 122 from nozzle 118 into space 120. The operator can, while standing in place, also deaerate the refractory material using deaerator equipment 174 having a head 176 with projecting tines. Handle 180 is gripped by the operator riding on platform 166 to periodically poke body 12 to release air entrapped therein.

In operation, expendable liner 20 is placed in furnace 10 on a preformed refractory base 24 and within outer wall 16 to provide the space 120. Hopper 110 is charged with a supply of silica particles 122. Feeder apparatus 14 is lifted by a crane using lugs 170 and set on the furnace liner 20. An operator on platform 166 adjusts controls 167 to actuate motor 126 to rotate screw conveyer 116 to achieve continuous and controlled feed of the silica particles into the space 120, and to actuate motor 150 to drive wheel 72 to rotate carriage 49 about axis A. When this occurs, the silica particles 122 are dispensed downwardly into space 120 in an annular pattern. After space 120 is filled, apparatus 14 is lifted by crane and removed from liner 20, whereafter sintering of body 12 into a continuous lining is commenced in accordance with normal practice. For this purpose, body 12 is vibrated to enhance packing of the particles and heated by torch to initiate sintering of the material. Scrap iron and other materials are charged into liner 12 and inductively heated by alternating electrical current to coils 18. This melts the scrap iron into an initial charge, completes sintering into an integral lining, and melts liner 20. The relined furnace is then ready for production operation.

While preferred methods and embodiments of the invention have been shown and described in detail to illustrate the invention, various changes and modifications may be made thereto without parting from the scope of the invention set forth in the following claims.

The embodiments of the invention in which an exclusive property or privilege is claimed are defined as follows:

1. A self-contained, portable, rotary particulate dispensing apparatus for lining a foundry furnace with particulate refractory material, said furnace in the unlined state comprising a self-sustaining expendable metal form, an outer wall surrounding said form and an annular space between said form and said wall, said form and said annular space being substantially concentric about a common axis, said apparatus comprising:

a platform removably engaging the top of said form, said platform having a pivot means and supporting a carriage rotatable about said pivot means;

means for locating said platform on said form such that said pivot means is aligned with said common axis;

an annular track on said platform circumscribing said pivot means radially inboard of, and concentric with, said space;

at least one wheel supporting said carriage upon said track during rotation of said carriage about said pivot means;

a hopper carried by said carriage for containing a charge of particulate refractory material, said hopper having an opening in the lower end thereof for discharging said particulate material therefrom;

a radially extending rotatable feeder communicating with said opening, said feeder having an input end for receiving said particulate material from said hopper and a discharge end remote from said input end and overlying said space for dispensing said material into said space as said carriage rotates;

means for conveying material from said input end to said discharge end of said feeder; and motor means supported by the platform for rotating said carriage about said pivot concurrent with the discharge of said material to dispense said material in an annular pattern into said space.

2. Apparatus according to claim 1 wherein said conveying means and said motor means are driven independently of each other.

3. Apparatus according to claim 1 wherein said motor means is carried by said carriage.

4. Apparatus according to claim 3 wherein said motor means is coupled to said wheel for driving said carriage.

* * * * *